US009945178B2

(12) United States Patent
Hentschel

(10) Patent No.: US 9,945,178 B2
(45) Date of Patent: Apr. 17, 2018

(54) FLEXIBLE DOOR ASSEMBLY

(71) Applicant: PERFORMAX GLOBAL, Aston, PA (US)

(72) Inventor: Dirk Hentschel, Soligen (DE)

(73) Assignee: PERFORMAX GLOBAL, Aston, PA (US)

( * ) Notice: Subject to any disclaimer, the term of this patent is extended or adjusted under 35 U.S.C. 154(b) by 0 days.

(21) Appl. No.: 15/193,311

(22) Filed: Jun. 27, 2016

(65) Prior Publication Data

US 2016/0376840 A1 Dec. 29, 2016

Related U.S. Application Data

(60) Provisional application No. 62/185,024, filed on Jun. 26, 2015.

(51) Int. Cl.

| | |
|---|---|
| ***A47H 3/00*** | (2006.01) |
| ***E06B 9/17*** | (2006.01) |
| ***E06B 9/58*** | (2006.01) |
| ***E06B 9/08*** | (2006.01) |
| ***E06B 9/13*** | (2006.01) |

(52) U.S. Cl.

CPC ..... *E06B 9/581* (2013.01); *E06B 9/08* (2013.01); *E06B 9/13* (2013.01); *E06B 2009/585* (2013.01)

(58) Field of Classification Search

CPC ... E06B 9/581; E06B 9/08; E06B 9/13; E06B 9/582; E06B 9/58; E06B 9/56; E06B 2009/587; E06B 9/40; E06B 9/17076

See application file for complete search history.

(56) References Cited

U.S. PATENT DOCUMENTS

| | | | | |
|---|---|---|---|---|
| 1,692,206 | A * | 11/1928 | Griffiths | E06B 9/54 160/273.1 |
| 4,586,552 | A * | 5/1986 | Labelle | E06B 9/582 160/133 |
| 4,938,273 | A * | 7/1990 | Dubbelman | E06B 9/0692 160/201 |
| 5,176,194 | A * | 1/1993 | Chigusa | E06B 9/581 160/272 |
| 5,209,281 | A * | 5/1993 | Kraeutler | E06B 9/0692 160/264 |
| 6,192,960 | B1 * | 2/2001 | Simon | E06B 9/0653 160/266 |
| 6,536,077 | B1 * | 3/2003 | Espey | E05D 15/165 16/106 |

(Continued)

*Primary Examiner* — Blair M Johnson
*Assistant Examiner* — Jeremy C Ramsey
(74) *Attorney, Agent, or Firm* — William H. Honaker; Dickinson Wright PLLC

(57) ABSTRACT

A roll up flexible door assembly includes a flexible door with guides mounted along the opposed sides. Opposed tracks are mounted at a spaced distance from one another with each of the tracks having inner edges positioned opposite one another. An angled guide liner is mounted to each track and extends longitudinally along at least a portion of the track. The angled guide liner is angled with respect to the inner edge with the angle increasing from the top to the bottom. The guides are received within the tracks and adapted to engage the angled guide liner as the flexible door is raised and lowered in the tracks. The guides and the angled guide liner tighten the flexible door as the flexible door is lowered.

15 Claims, 7 Drawing Sheets

(56) References Cited

U.S. PATENT DOCUMENTS

2014/0345812 A1* 11/2014 Casey ..... E06B 9/581
160/273.1
2015/0292262 A1* 10/2015 Miller ..... E06B 9/13
160/270

* cited by examiner

FLEXIBLE DOOR ASSEMBLY

RELATED APPLICATIONS

This application claims the benefit of U.S. Provisional Application No. 62/185,024 filed on Jun. 26, 2015.

STATEMENT REGARDING FEDERALLY SPONSORED RESEARCH

NONE.

TECHNICAL FIELD

This invention relates generally to roll up doors and more particularly to flexible roll up doors.

BACKGROUND OF THE INVENTION

Roll up flexible doors are well known. Typical roll up flexible doors have a flexible material that is mounted upon a shaft to allow the material to be rolled upon and unrolled from the shaft. Some of these doors include tracks mounted on the sides of the opening to guide and hold the flexible material in place.

One of the problems with known doors is the lack of a tight fit across the opening. Even with track mounted doors, the doors can have a lose fit, particularly after repeated use. This can create numerous disadvantages, such as unsightly appearance and reduced thermal barrier.

Another problem with flexible doors that are mounted in tracks is when the door is inadvertently hit by for example a fork lift. Typical doors are damaged and require replacement. Either the flexible door has to be reinstalled or replaced, or in more severe situations, the tracks have to be replaced.

It is desirable to provide a flexible door that tightens laterally as it is lowered to eliminate the problems associated with loose doors. Additionally, it is desirable to provide a flexible door that is resistant to damage and easily reinstalled if inadvertently hit during use.

SUMMARY OF THE INVENTION

In general terms, the present invention provides an improved flexible door assembly that overcomes the problems of known flexible doors.

The present invention provides a roll up flexible door assembly which includes a flexible door having opposed sides and a front face and rear face. Guides are mounted along the opposed sides of the flexible door.

Opposed tracks are mounted on the opposite walls of an opening. The tracks are mounted vertically at a spaced distance from one another. Each of the tracks has an upper end and lower end, a rear surface and a front surface spaced from the rear surface generally covering the rear surface. The front and rear surfaces of each track have inner edges with the inner edges of each track being positioned opposite one another.

First and second angled guide liners are mounted to the front and rear surfaces of each track and extend longitudinally along at least a portion of the surfaces. The angled guide liners have a top adjacent the upper end of the track and a bottom adjacent the lower end of the track. The angled guide liners are angled with respect to the inner edges with the angle increasing from the top to the bottom of the tracks. It should be appreciated that only one guide liner could be used in each track if desired, but applicant has found that having two provides for better control and tightening of the door as it is closed.

The guides are operatively received within the tracks and adapted to engage the angled guide liners as the flexible door is raised and lowered in the tracks. The guides and the angled guide liners tighten the flexible door as the flexible door is lowered. It should be appreciated that with two guide liners in each track, it is desired to have two guides, one on the front face of the flexible door and the other on the rear face spaced along the edges. With one angled guide liner, only one set of guides on one side would be needed spaced along the edges.

These and other features and advantages of this invention will become more apparent to those skilled in the art from the detailed description of a preferred embodiment. The drawings that accompany the detailed description are described below.

DETAILED DESCRIPTION OF A PREFERRED EMBODIMENT

Figure 1:
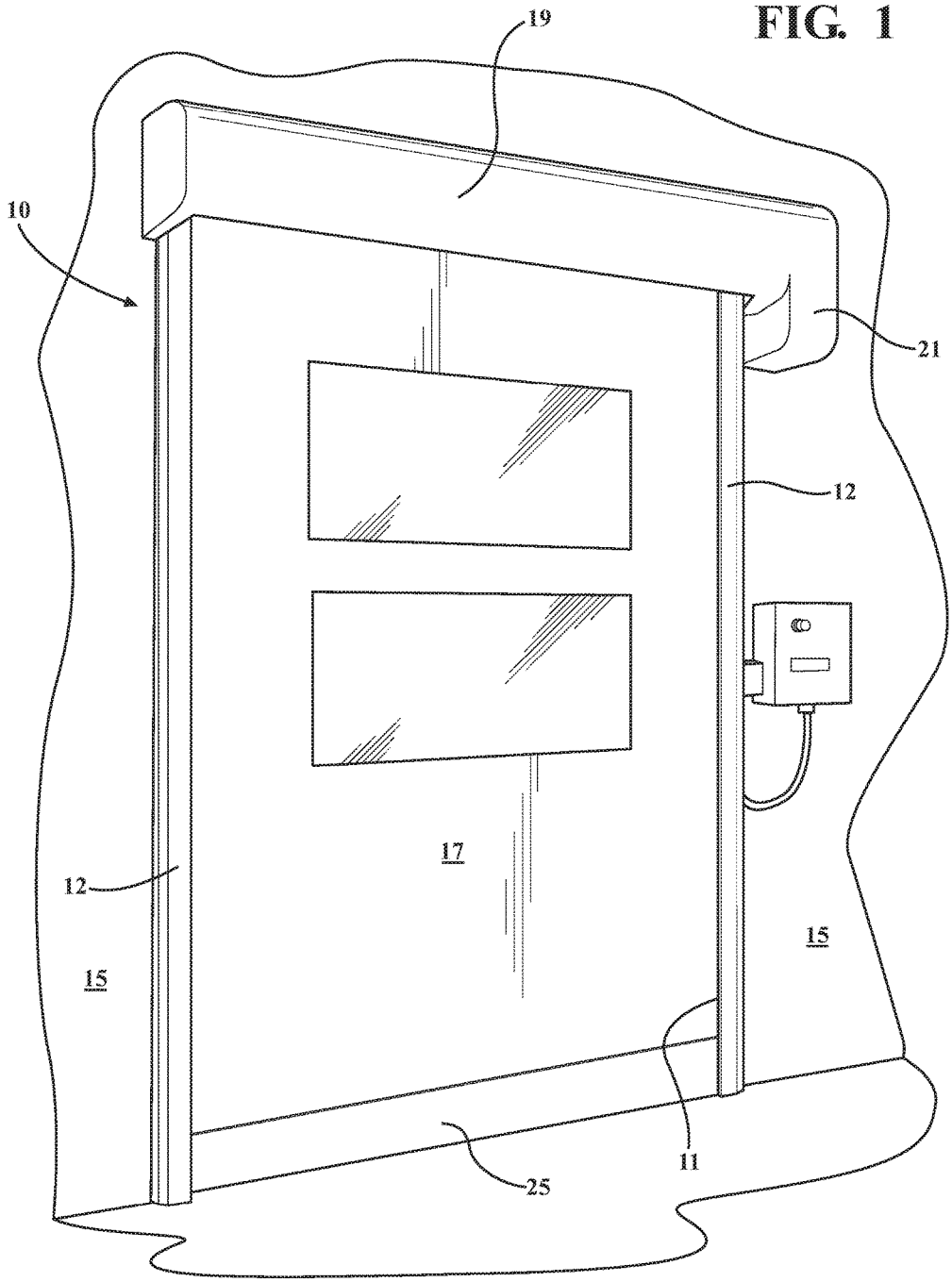
FIG. 1 is a perspective view of the flexible door of the present invention.

The flexible door assembly of the present invention is generally shown at 10 in FIG. 1. As illustrated, an opening 11 has sidewalls 15 with each sidewall having a door track assembly 12 mounted to it. A flexible door 17 is operatively mounted within the opposed door track assemblies 12 and can open and close the opening 11 by moving up and down the side track assemblies 12. The flexible doors 17 are typically made of vinyl, cloth or other flexible materials.

Figure 2:
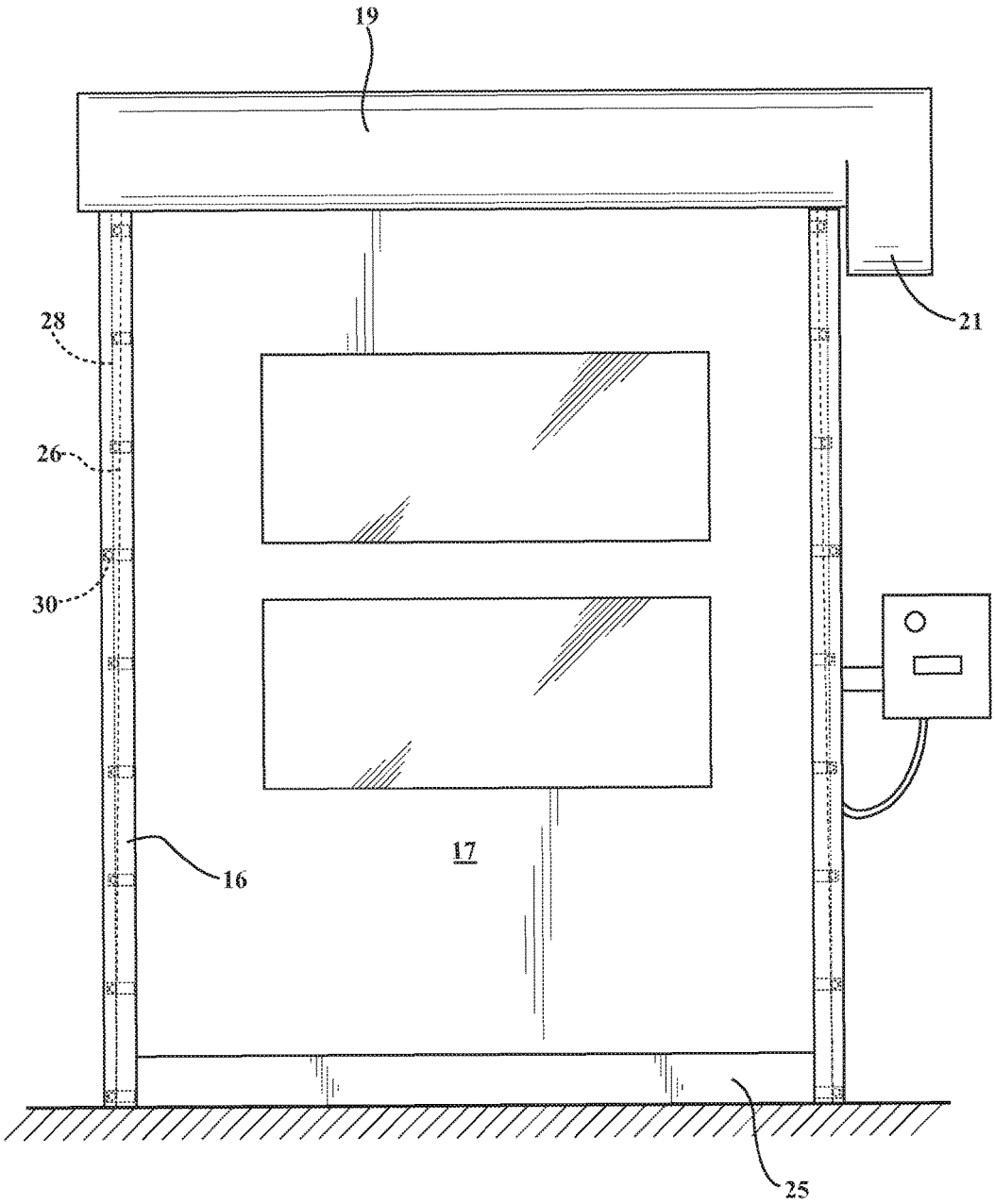
FIG. 2 is a front view of the flexible of the present invention with the angled guide liners and guides shown in phantom.

With reference to FIGS. 1 and 2, the flexible door 17 is wound and unwound upon a shaft within a housing 19 to open and close the door. The shaft is either rotated by a motor 21 or by hand through the use of for example a pull chain (not shown). A bottom bar 25 is typically mounted to the bottom of the door 17 to assist in unwinding it. The bottom bar 25 is relatively heavy when compared to the door 17 to assist in closing the door 17 and holding the door in the closed position. In the example door shown, the bottom bar 25 is a one piece extruded aluminum bar, but could also be several pieces of metal, aluminum etc.

Figure 3:
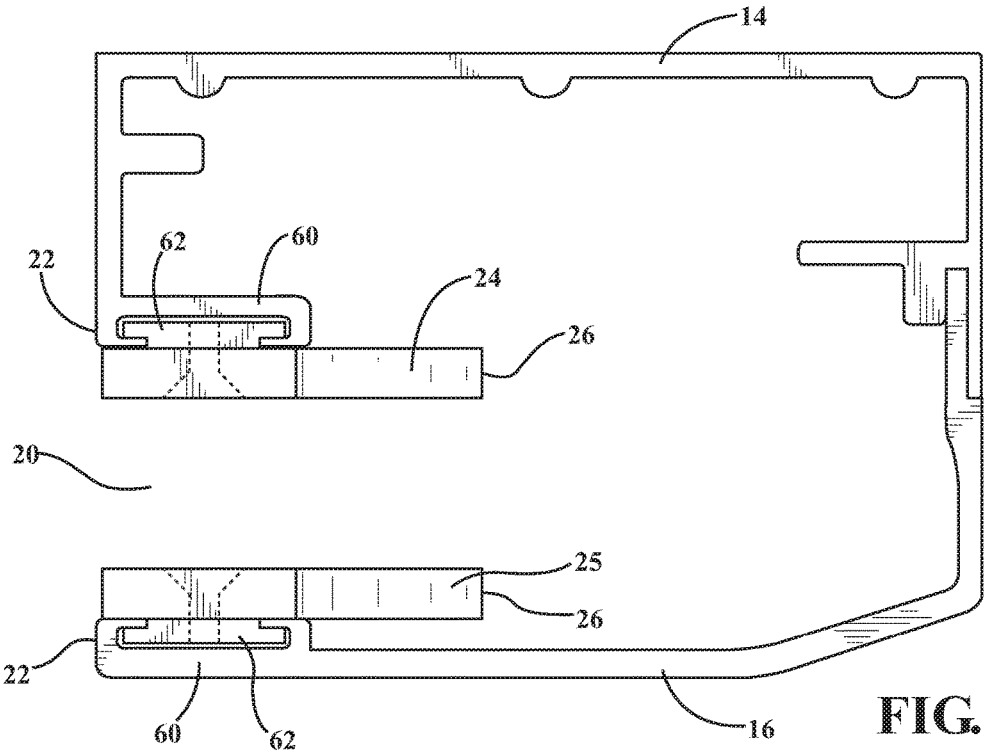
FIG. 3 is a cross sectional view of the track of the present invention.

As illustrated in FIG. 3, the door track assembly 12 includes a rear section 14 and front section 16. In the disclosed embodiment, the front and rear sections 16 and 14 are extruded from aluminum. The rear section 14 is adapted to be mounted to the sidewall of the opening in the doorway. As disclosed, the rear section 14 is generally u-shaped. The front section 16 is generally L-shaped and covers the rear section 16 and is fixed to the rear section 14. The front and rear sections 16 and 14 are spaced from each other to define the opening 20. In the disclosed invention, the front and rear sections 16 and 14 are connected together by screws inserted into the sides opposite the opening 20.

The front and rear sections include longitudinal track edges 22. At least one angled guide liner 24, and as disclosed, a second angled guide liner 25 are mounted within the opening 20 adjacent the track edges 22. As will be discussed below, the flexible door 17 is positioned within the opening and between the angled liners 24 and 25. Guide members 30 or 40 are mounted to the sides of the flexible door and engage and traverse the guide liners 24 and 25.

Figure 5:
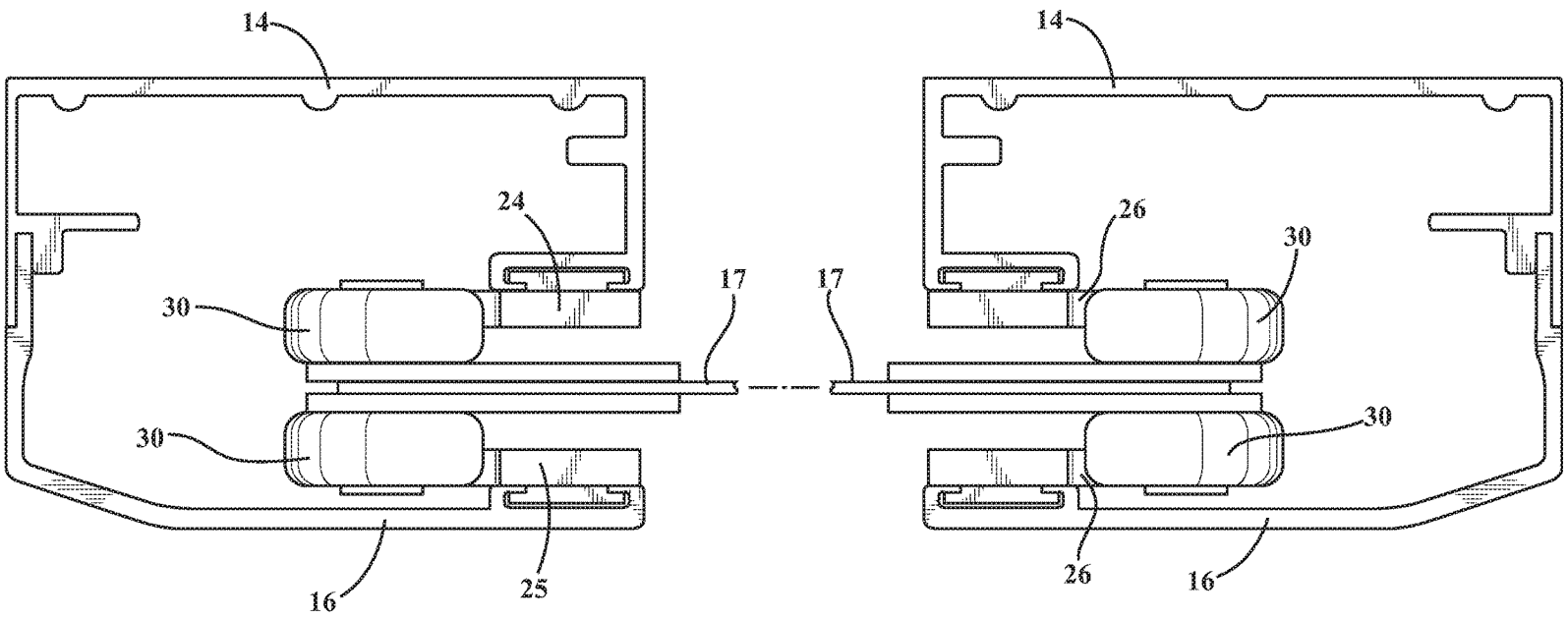
FIG. 5 is a cross sectional view of the track of the present invention positioned near the top of the track.
Figure 6:
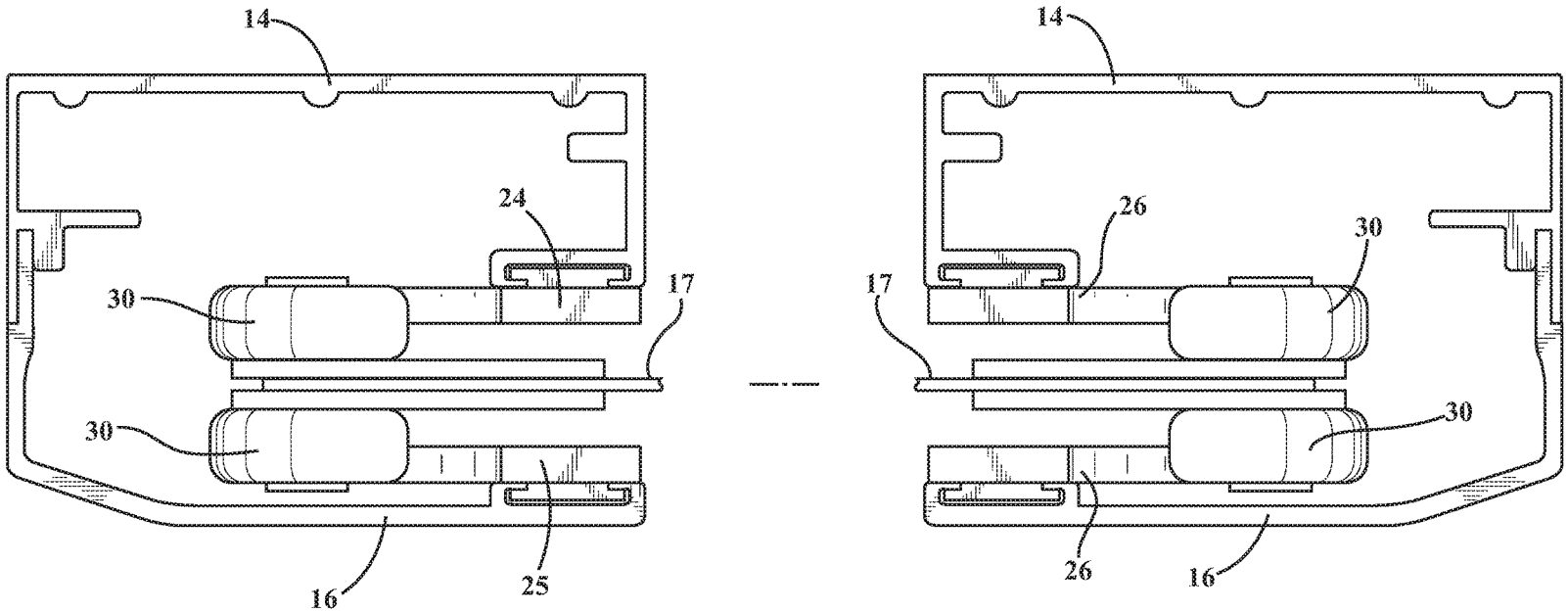
FIG. 6 is a cross sectional view of the track of the present invention positioned near the bottom of the track.

With reference to FIGS. 2, through 6, the angled guide liners 24 and 25 have a guide surface 26 angled with respect to the track edges 22 and the vertical centerline 28 of each track. The guide surface 26 guides the guide members 30 or 40 mounted to the opposite edges of flexible door 17, see FIGS. 7, 8 and 9. As the door or curtain is closed, the guide members 30 or 40 engage the guide surface 26 and are forced outwardly as the door is lowered. This tightens the flexible door 17 as the door is lowered to the bottom of its travel path. The angled guide surfaces 26 are illustrated in FIGS. 5 and 6. In FIG. 5, the flexible door 17 is near the top and the width of the liners 24 and 25 is narrower than the width of the liners 24 and 25 nearer the bottom of the track as shown in FIG. 6.

Figure 4A:
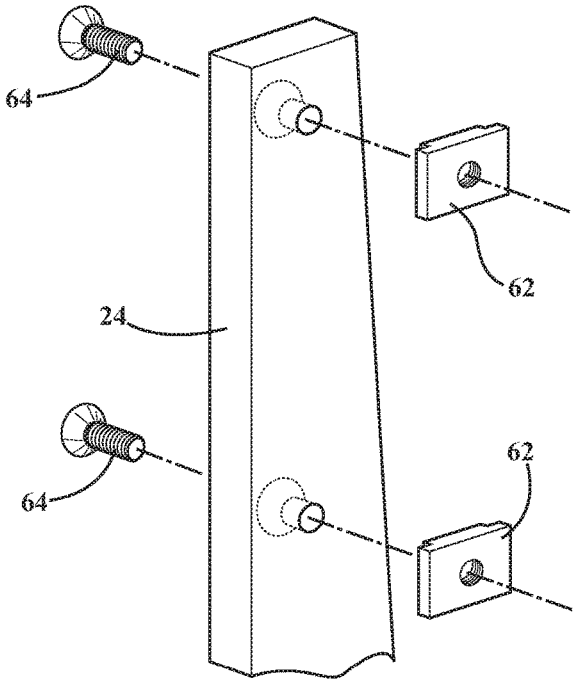
FIG. 4A is a partial perspective view of the angled guide member and retention member.
Figure 4:
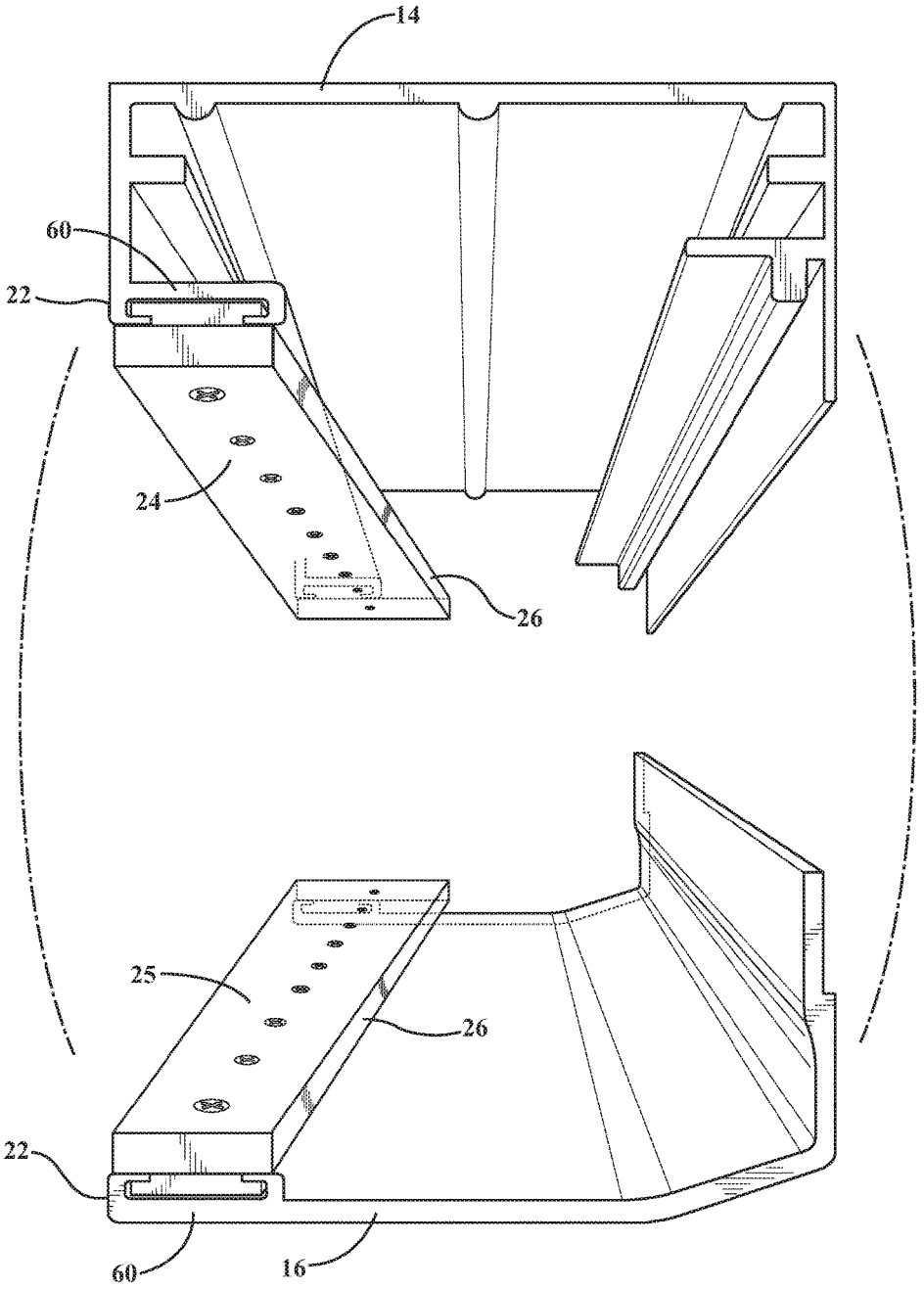
FIG. 4 is an exploded view of the track of the present invention.

With reference to FIGS. 3, 4 and 4A, mounting channels 60 are formed to receive retention members 62 that generally mate with the channels 60. As disclosed, the channels 60 are generally T-shaped in cross-section. The retention members 62 of the disclosed embodiment are square inserts that protrude from the guide liners 24 and 25 and generally mate with the channels 60. Screws 64 are driven through the liners 24 and 25 and into the retention members 62. In the disclosed embodiment, the retention members 62 are spaced apart on about one (1) foot centers along the length of liners 24 and 25. The retention members 62 are inserted onto the channels 60 and then the screws 64 are tightened to retain the liners 24 and 25 to the track 12.

Figure 7:
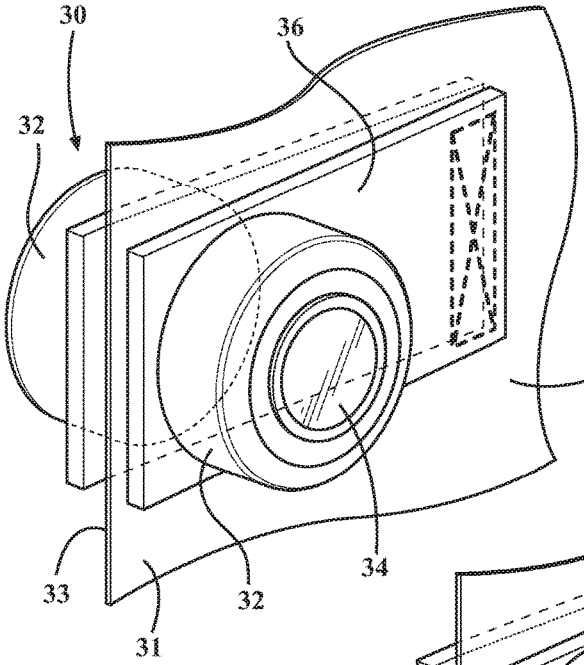
FIG. 7 is a perspective view of a first embodiment of the guide members.
Figure 8:
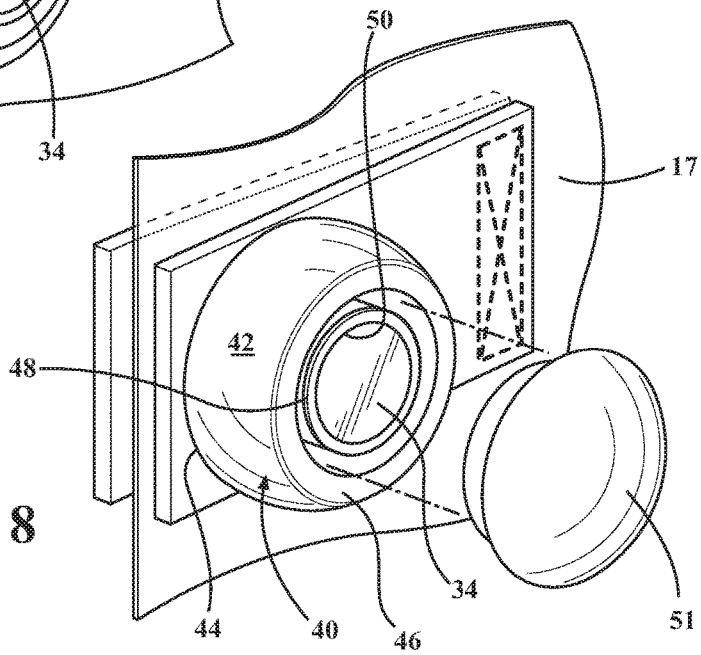
FIG. 8 is a perspective view of a second embodiment of the guide members.
Figure 9:
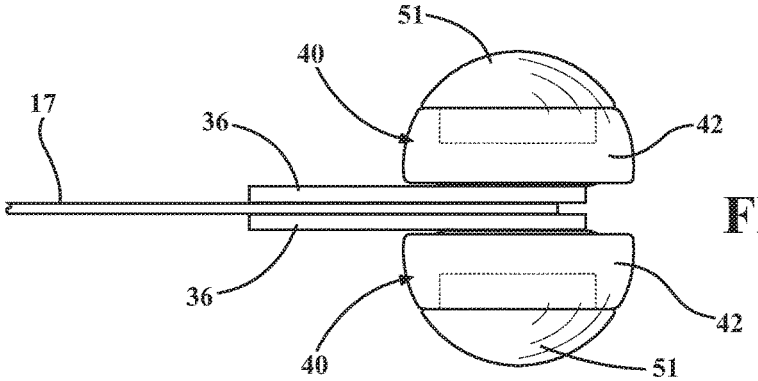
FIG. 9 is a perspective view of a third embodiment of the guide members.

The guide members 30 and 40 are disclosed in FIGS. 7, 8 and 9. In FIG. 7, the guide roller bearing 30 is illustrated as track roller bearings. The outer ring of the track roller bearing rides upon internal bearings, normally mounted in a bearing race which is positioned upon the axle 34. The guide members 30 have at least one roller 32 and in the disclosed embodiment two opposed rollers 32 mounted upon an axle 34. The two rollers 32 that are illustrated are mounted on the front 31 and back 33 of the flexible door 17. Reinforcement strips 36 are mounted adjacent the roller 32 to reinforce the connection of the roller 32. As shown in FIG. 2, the rollers 32 are positioned on the edge of the flexible door 17 and spaced along the length of the door 17.

In a further embodiment of the present invention, the flexible door 17 is adapted to be released from the track 12 if it is inadvertently hit by something, like a vehicle. The door 17 releases from the track 12 to avoid damage to the door 17, track 12 or the building to which the track 12 is attached. To allow release, the door 17 has a series or guide members 40 attached along the edge of the door 17. The guide members 40 engage the angled guide liner 24 of track 12 and guide the door 17 up and down the track 12. If the door 17 is hit, the guide members 40 snap out of the track 12. Once out, guide members can be reinserted into the track 12. For example, reinsertion can be done manually, or by raising the door 17 to the top and then lowering it to reinsert the guide members 40 into the track 12. FIG. 8 illustrates the use of a single guide member 40 which is preferred for efficient release of the door 17. In FIG. 9, opposed pairs of guide members 40 are illustrated. As will be appreciated, if one guide member 40 is used, then only one guide liner 24 or 25 would be used.

In order to allow efficient quick release without damage to the door 17 or the track 12, the shape of the guide members 40 is important. A large impact against the door will force the door away from the opening 11 and pull one or more of the guide members 40 from the track. In this way, the track and guide members 40 are not damaged.

In FIG. 8, an embodiment of the release guide member 40 is illustrated. In this embodiment, the guide member 40 or roller is a generally dome shaped wheel. The guide member 40 or roller has a curved outer wall 42 extending from a base 44 to a top edge 46. The curved outer wall 42 defines a cavity 48 that is closed by base 44. A hole 50 is formed in the base 44 for receipt of a fastener, such as a screw or bolt. With reference to FIG. 8, the cavity 48 is closed with a dome shaped cap 51 to create an overall generally smooth dome shaped wheel 40.

In use, the guide members 30 or 40 are installed at spaced locations along the flexible door 17. At each location along the door, a pair of guide members 30 or 40 is positioned on opposite sides of the flexible door 17 and if desired on the front and back, as shown in FIGS. 7 and 9. As illustrated in FIG. 7, a hole is formed in the flexible door 17 and a bolt or axle 34 is inserted through the aperture and receives a second guide roller 32 to attach the opposed guide member 30 to the opposite sides of the door.

The guide members 30 or 40 roll upon the track 12 as the door 17 raises and lowers. As the guide members traverse the length of the guide liners 24 and 25 from top to bottom, the flexible door 17 is laterally tightened, see FIGS. 2, 5 and 6.

It should be appreciated by one of ordinary skill in the art that guide members 30 and 40 could also be attached to only one side of the door 17 instead of to the opposite sides of the door. This is illustrated in FIG. 8. With one guide member 30 or 40, only one guide liner 24 or 25 would be needed.

The foregoing invention has been described in accordance with the relevant legal standards, thus the description is exemplary rather than limiting in nature. Variations and modifications to the disclosed embodiment may become apparent to those skilled in the art and do come within the scope of the invention. Accordingly, the scope of legal protection afforded this invention can only be determined by studying the following claims.

I claim:

1. A roll up flexible door assembly comprising:

a flexible door having opposed sides and a front face and rear face, said sides of said flexible door are parallel to one another;

guide members mounted along the opposed sides;

opposed tracks adapted to be mounted vertically at a spaced distance from one another, each of said tracks having an upper end and lower end, a rear surface and a front surface spaced from said rear surface generally covering said rear surface and defining a longitudinal opening between said front and rear surface for receipt of said flexible door and said guide members; said front and rear surface having facing inner edges, said inner edges of each track positioned opposite one another;

a first angled guide liner mounted to one of said front or rear surfaces of each track and extending longitudinally along at least a portion of said front or rear surface, said angled guide liner having a top adjacent said upper end of said track and a bottom adjacent said lower end of said track, said angled guide liner having a width that increases from [being angled with respect to said inner edge with said angle increasing] said top to said bottom;

said guide members [operatively] received within said tracks [and adapted] to engage said angled guide liner as said flexible door is raised and lowered in said tracks, said guide members and said angled guide liner tighten said flexible door as said flexible door is lowered.

2. The flexible door assembly of claim 1, wherein said guide members are rollers and roll against said angled guide liner.

3. The flexible door assembly of claim 2, wherein said rollers are generally dome shaped.

4. The flexible door assembly of claim 1, wherein said tracks are metal.

5. The flexible door assembly of claim 1, wherein said tracks are steel.

6. The flexible door assembly of claim 1, wherein said tracks are aluminum.

7. The flexible door assembly of claim 1, wherein said flexible door is vinyl.

8. The flexible door assembly of claim 1, further including a drive mechanism, said flexible door being attached to said drive mechanism such that said flexible door is rolled up or down.

9. The flexible door assembly of claim 2, further including a weight mounted to said flexible door to assist in unrolling said flexible door.

10. The flexible door assembly of claim 3, wherein said roller has a curved outer wall extending from a base to a top edge, said curved outer wall defines a cavity that is closed by said base, a hole extends through said base for receipt of a fastener, a dome shaped cap closes said cavity creating an overall generally smooth dome shaped roller.

11. The flexible door assembly of claim 1, further including a second angled guide liner, [said second angled guide liner being generally identical to said first angled guide liner,] said second angled guide liner being mounted to the other of said front or rear surfaces and positioned opposite said first angled guide liner.

12. The flexible door assembly of claim 11, wherein said front and rear surfaces each include a longitudinal channel for receipt of said first and second angled guide liners.

13. The flexible door assembly of claim 12, wherein said first and second angled guide liners each include at least one retention member that mates with a respective channel, each said retention member is inserted into said respective channel to retain said first and second angled guide liners.

14. The flexible door assembly of claim 11, wherein each said guide member engages a respective one of said first and second angled guide liners.

15. The flexible door assembly of claim 11, wherein said flexible door has guide members on said front and rear faces, said flexible door is received between said angled guide liners and said guide members engage a respective one of said angled guide liners.

* * * * *